United States Patent [19]

Mitchell

[11] Patent Number: 4,674,493

[45] Date of Patent: Jun. 23, 1987

[54] UNDERWATER BREATHING APPARATUS

[76] Inventor: Dan E. Mitchell, P.O. Box 12613, Reno, Nev. 89510

[21] Appl. No.: 877,608

[22] Filed: Jun. 23, 1986

[51] Int. Cl.[4] ..... B63C 11/20

[52] U.S. Cl. ..... 128/202.14; 128/204.26; 128/201.11; 128/201.27; 405/186; 417/61; 415/7

[58] Field of Search ..... 128/204.26, 201.27, 128/201.28, 201.11, 202.14; 405/185, 186; 417/61; 415/7

[56] References Cited

U.S. PATENT DOCUMENTS

| | | | |
|---|---|---|---|
| 813,431 | 2/1906 | Iwanami et al. | 128/201.27 |
| 829,274 | 8/1906 | Knoff | 128/201.27 |
| 835,950 | 11/1906 | Iwanami . | |
| 2,593,988 | 4/1952 | Cousteau . | |
| 3,050,055 | 8/1962 | Vautin | 417/61 |
| 3,393,643 | 7/1968 | Herman | 415/7 |
| 3,397,647 | 8/1968 | Daniel | 417/61 |
| 3,398,878 | 8/1968 | Quiram et al. | 417/61 |
| 3,467,091 | 9/1969 | Aragona | 128/201.11 |
| 3,470,822 | 10/1969 | Evans et al. | 417/61 |
| 3,951,142 | 4/1976 | Martin | 128/201.11 |
| 3,968,794 | 7/1976 | O'Neill . | |
| 4,245,632 | 1/1981 | Houston | 128/201.27 |
| 4,284,075 | 8/1981 | Krasberg . | |

FOREIGN PATENT DOCUMENTS

| | | | |
|---|---|---|---|
| 0006726 | 6/1979 | European Pat. Off. . | |
| 2323015 | 11/1974 | Fed. Rep. of Germany | 405/186 |

*Primary Examiner*—Henry J. Recla

*Attorney, Agent, or Firm*—Townsend and Townsend

[57] ABSTRACT

A floating apparatus for providing pressurized air to a submerged swimmer. A container is sealed and waterproofed so that it will float on the surface of the water and has an inlet above the water and an outlet below the water. The outlet is adapted to be coupled to a hose which will provide air to the submerged swimmer. The inside of the container houses a pump which couples the inlet to the outlet and forces pressurized air through the outlet. The pump is driven by an electric motor within the container.

15 Claims, 2 Drawing Figures

UNDERWATER BREATHING APPARATUS

BACKGROUND

The present invention relates to apparatus for pumping air to a submerged diver.

Many types of apparatus have been designed to allow a swimmer to breathe under water. The simplest, a snorkel, is simply a tube which extends from the swimmer's mouth to the surface. The disadvantage of a snorkel is that a swimmer would have to hold his breath to go any deeper than the surface of the water. Another apparatus is a pressurized tank which a diver wears on his back to supply air through a hose to a regulator in the diver's mouth. The diver can thus breathe at depths below the surface with the tank providing air at sufficient pressure to compensate for the water pressure at the particular depth. However, such a device requires a diver to undergo an extensive training course in the United States because of the dangers involved in breathing highly pressurized air. Another method for a diver to breathe under water is to have a pump located on the surface on a boat or otherwise pumping air through a pressure hose to the submerged diver. This air may be fed to the diver through a regulator or may simply be fed into a pressurized suit worn by the diver, such as for deep sea diving.

Another apparatus has been designed to float independently on the surface of the water and pump air at relatively shallow depths to a submerged swimmer. Such a device consists of a pump and a gasoline engine which are held afloat by attaching them to an innertube. However, such a device is only marginally seaworthy and risks contamination of the air from the exhaust of the gasoline engine. There is a need for a small floating device which can safely pump air to a submerged swimmer without contaminating the air.

SUMMARY OF THE INVENTION

The present invention is a floating apparatus for providing pressurized air to a submerged swimmer. A container is sealed so that it will float on the surface of the water and has an inlet above the water and an outlet below the water. The outlet is adapted to be coupled to a hose which will provide air to the submerged swimmer. The inside of the container houses a pump which couples the inlet to the outlet and forces pressurized air through the outlet. The pump is driven by an electric motor within the container.

The use of an electric motor eliminates the risk of exhaust fumes contaminating the air. Preferably, a battery powered 12 volt electric motor is used. By using a sealed container, a seaworthy vessel is obtained with the pump and motor being protected from the elements. The container preferably contains an escape valve coupled to the outlet for venting air to the interior of the container when the pressure in the outlet exceeds 24 psi (pounds per square inch). A purge valve will also operate to eliminate any water which may accumulate within the container. The inlet to the container is coupled to a hollow aluminum tube extending 30" vertically so that waves and spray will not get water into the air inlet. There is an in-line float valve, placed after the pump, that will shut off the air to the swimmer in the event of water entering the inlet tube or if the apparatus should overturn.

The container is oval shaped with a circular horizontal cross-section so that it will float in the water and resist tipping. A flange extends around the horizontal section of the container and is covered by a rubber ring which compresses the sides of the flange to provide an additional sealing function. The rubber ring is composed of a buoyant foam to help support the container in the water. When on land, the container can be rolled on its side and rolled along on the rubber ring with a handle attached to either the top or the bottom being used to pull the container.

In one alternate embodiment, a pressure tank can be coupled to the hose between the outlet of the container and the submerged swimmer. This pressure tank will hold an amount of pressurized air sufficient to allow the swimmer to comfortably surface in the event of a pump failure or shutdown.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
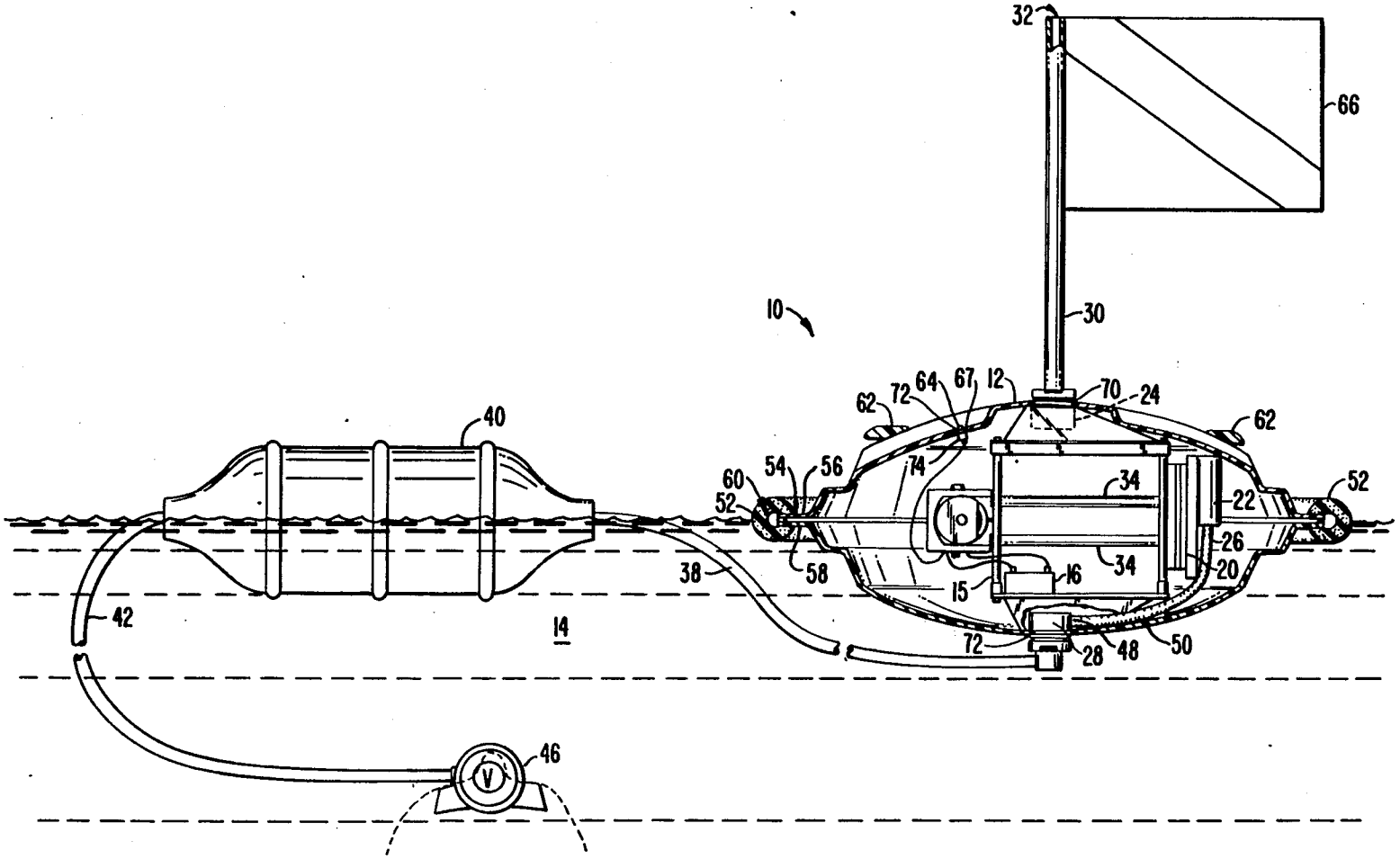
FIG. 1 is a side plan view, partially broken away, of one embodiment of an underwater breathing apparatus according to the present invention.

FIG. 1 shows an underwater breathing device 10 according to the present invention. A plastic container shell 12 is sealed and pressurized so that device 10 can float in water 14. A support structure 15 mounted in shell 12 supports a battery 16, a motor 18 and a pump 20. Pump 20 is coupled to a float valve 22 then to an outlet hose 26 coupled to an exhaust valve 28. Air is provided to inlet valve 24 through an intake pipe 30 with an opening at a top end 32. Pump 20 is driven by motor 18 through a pair of piston rods 34 which are driven by a cam 36 coupled to motor 18. From pump 20, air is pumped to float valve 22, then to exhaust valve 28, then to a hose 38 to an air tank 40, then through a hose 42 to a breathing regulator 46 for placement in a swimmer's mouth.

In operation, air at atmospheric pressure is provided through opening 32 in intake pipe 30 and supplied through intake valve 24 to pump 20. Pump 20 then pressurizes the air, preferably to 24 psi, and forces it through a float valve 22, then to the outlet 28 and hose 38 to the swimmer. Tank 40 may alternately be omitted, so that air is pumped directly from hose 38 to regulator 46. Air pressure above 24 psi in outlet hose 26 is vented to the interior of container shell 12 through a check valve 48. A drain plug 50 serves to eliminate any water which may accumulate in the bottom of container shell 12. Container 10 will float because it is sealed and also due to the use of a rubber tire 52 encircling the container. This rubber tire can be seen more clearly in FIG. 2, which is a view of device 10 of FIG. 1 from the bottom. Tire 52 has a slot 54 which compresses flanges 56 and 58 of container shell 12 to assist in sealing container shell 12. Tire 52 is made of a foam material 60 which is buoyant and aids in floatation.

The container is also provided with a pair of handles 62, a circuit breaker 67, charger posts 74 and an on/off switch 64. Battery charging posts 74 are provided to allow recharging the battery 16. A diving flag 66 is attached to inlet pipe 30 to warn nearby boaters of the presence of an underwater swimmer.

Figure 2:
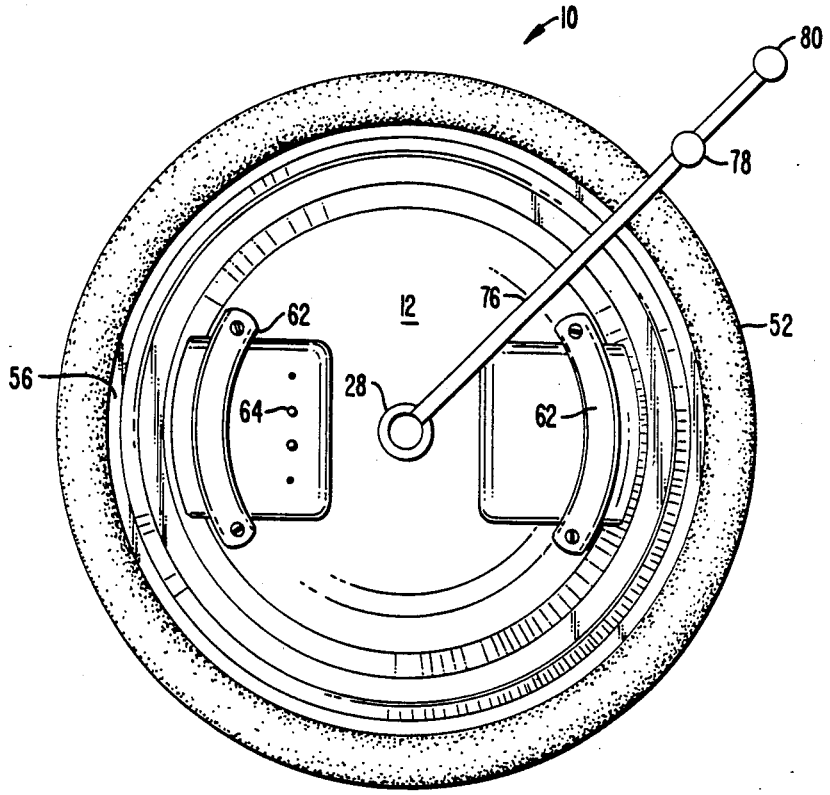
FIG. 2 is a bottom plan view of the embodiment of FIG. 1.

Turning now to FIG. 2, a bottom view of container 10 of FIG. 1 is shown. In addition to handle 62, a bar 76 with handles 78, 80 is attached to outlet valve 28. Bar 76 will rotate at its coupling to valve 28, allowing container 10 to be rolled along tire 52 by pulling on one of handles 78, 80.

As will be understood by those familiar with the art, the present invention may be embodied in other specific forms without departing from the spirit or essential characteristics thereof. For example, device 10 may be of another shape or may be made of other materials than plastic, such as lightweight aluminum. Accordingly, the disclosure of the preferred embodiments of the invention is intended to be illustrative, but not limiting, of the scope of the invention which is set forth in the following claims.

What is claimed is:

1. A floating apparatus for providing pressurized air to a submerged swimmer, comprising:

a waterproof container adapted to float on the water having an inlet above the water and an outlet below the water, said outlet being adapted to couple to a hose to provide air to a submerged swimmer, said container being circular in a section bisected by a horizontal plane, said container having an outward projecting flange at said horizontal section;

a rubber ring, coupled to said container and having an interior slot for engaging said flange and applying compressing pressure to opposing sides of said flange;

a pump attached to the inside of said container coupling said inlet to said outlet, said pump being adapted force pressurized air through said outlet; and an electric motor coupled to said pump for driving said pump.

2. The apparatus of claim 1 further comprising an escape valve coupled to said outlet for venting air to an interior of said container when the pressure in said outlet exceeds a predetermined value.

3. The apparatus of claim 1 further comprising a float valve coupled between said pump and said outlet, said float valve being operable to prevent water from exiting through said outlet when said apparatus is capsized or filled with water.

4. The apparatus of claim 1 further comprising a drain plug coupled to a bottom side of said container for releasing any accumulated water within said container.

5. The apparatus of claim 1 wherein said rubber ring is comprised of a buoyant foam.

6. The apparatus of claim 1 further comprising a detachable handle rotatably coupled to one of a top and a bottom of said container, such that said container can be placed on its side and pulled with said handle on land, causing said container to roll on said rubber ring.

7. The apparatus of claim 1 further comprising a tube coupled to said inlet and extending vertically above said container.

8. The apparatus of claim 1 further comprising a hose coupled at a first end to said outlet and a regulator coupled to a second end of said hose.

9. The apparatus of claim 8 further comprising a pressure tank coupled to said hose between said first and second ends.

10. The apparatus of claim 1 further comprising a check valve coupled between said pump and said outlet for releasing air above a predetermined pressure.

11. The apparatus of claim 10 further comprising a tube coupled to said inlet and extending vertically above said container.

12. The apparatus of claim 5 further comprising:

a platform internal to said container having said pump mounted on a first side and said motor mounted on a second side; and a battery mounted to said platform between said pump and said motor for supplying power to said motor.

13. A floating apparatus for providing pressurized air to a submerged swimmer, comprising:

a waterproof container adapted to float on the water having an inlet above the water and an outlet below the water, said outlet being adapted to couple to a hose to provide air to a submerged swimmer, said container being circular in a section bisected by a horizontal plane and having an outward projecting flange at said horizontal section;

a pump attached to the inside of said container coupling said inlet to said outlet, said pump being adapted to force pressurized air through said outlet;

an electric motor coupled to said pump for driving said pump;

a float valve coupled between said pump and said outlet, said float valve being operable to prevent water from exiting through said outlet when said apparatus is capsized or filled with water;

a pressure valve coupled to said outlet for venting air to an interior of said container when the pressure in said outlet exceeds a predetermined value; and a rubber ring, coupled to said container and having an interior slot for engaging said flange and applying compressing pressure to opposing sides of said flange.

14. The apparatus of claim 13 wherein said rubber ring is comprised of a buoyant foam.

15. The apparatus of claim 13 further comprising a detachable handle rotatably coupled to one of a top and a bottom of said container, such that said container can be placed on its side and pulled with said handle on land, causing said container to roll on said rubber ring.

* * * * *